United States Patent [19]

van Bilderbeek

[11] 4,154,552

[45] May 15, 1979

[54] LEVEL SUBSEA TEMPLATE INSTALLATION

[75] Inventor: Bernard H. van Bilderbeek, Ventura, Calif.

[73] Assignee: Vetco, Inc., Ventura, Calif.

[21] Appl. No.: 853,327

[22] Filed: Nov. 21, 1977

[51] Int. Cl.[2] ..... E02D 27/52

[52] U.S. Cl. ..... 405/229; 405/233

[58] Field of Search ..... 61/50, 86, 87, 94, 98, 61/99, 100; 166/0.5; 175/7; 405/222, 229

[56] References Cited

U.S. PATENT DOCUMENTS

| | | | |
|---|---|---|---|
| 3,314,239 | 4/1967 | Baron et al. | 61/63 X |
| 3,519,071 | 7/1970 | Word, Jr. | 166/0.5 |

FOREIGN PATENT DOCUMENTS

| | | | |
|---|---|---|---|
| 35795 | 9/1922 | Norway | 61/100 |
| 1136178 | 12/1968 | United Kingdom | 61/50 |

*Primary Examiner*—Jacob Shapiro

*Attorney, Agent, or Firm*—Subkow and Kriegel

[57] ABSTRACT

A subsea template is installed on a level base provided by lowering and landing on the floor of the sea a container to which is supplied a quantity of fluent, settable material which flows to form a level upper surface on which the template is landed. The template is fixed in place by setting a pile into the floor of the sea. The receptacle is a guide base anchoring guidelines on which the template is lowered after hardening of the fluent material, or, in the case of a guidelineless installation, the base and template are lowered together and the template raised above the base during setting of the fluent material and then lowered onto the level base.

20 Claims, 14 Drawing Figures

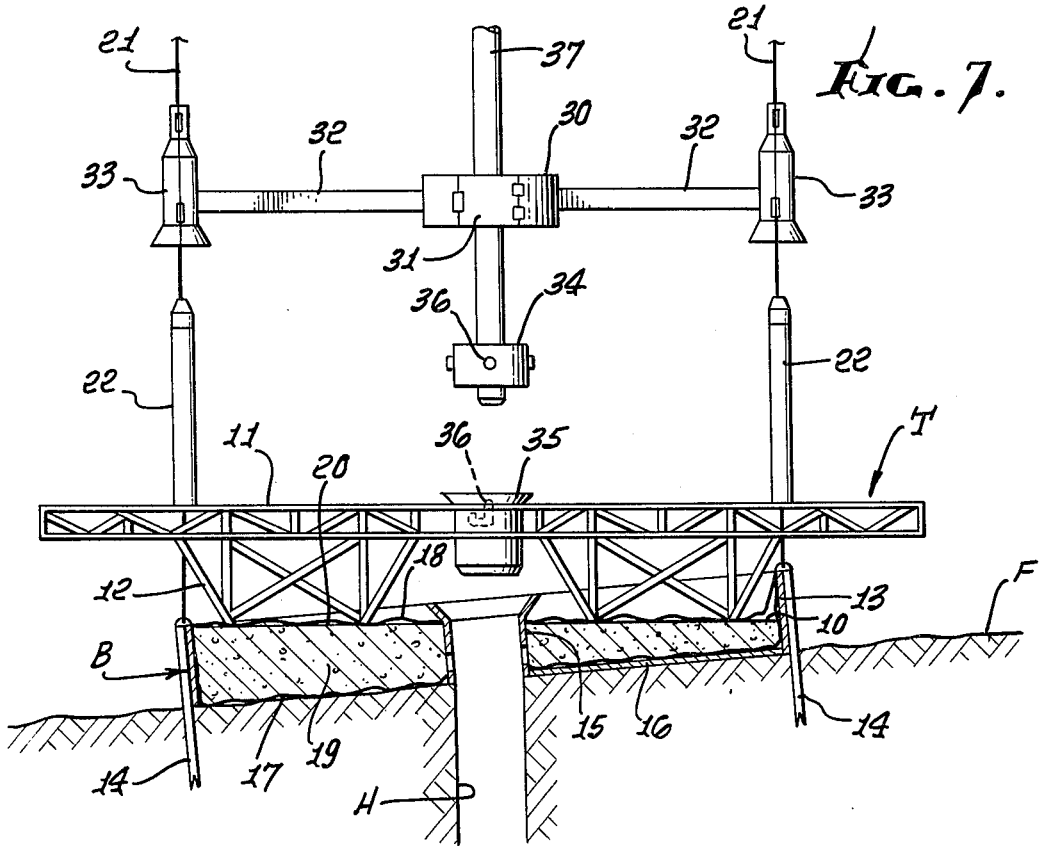
FIG. 7.
FIG. 8.
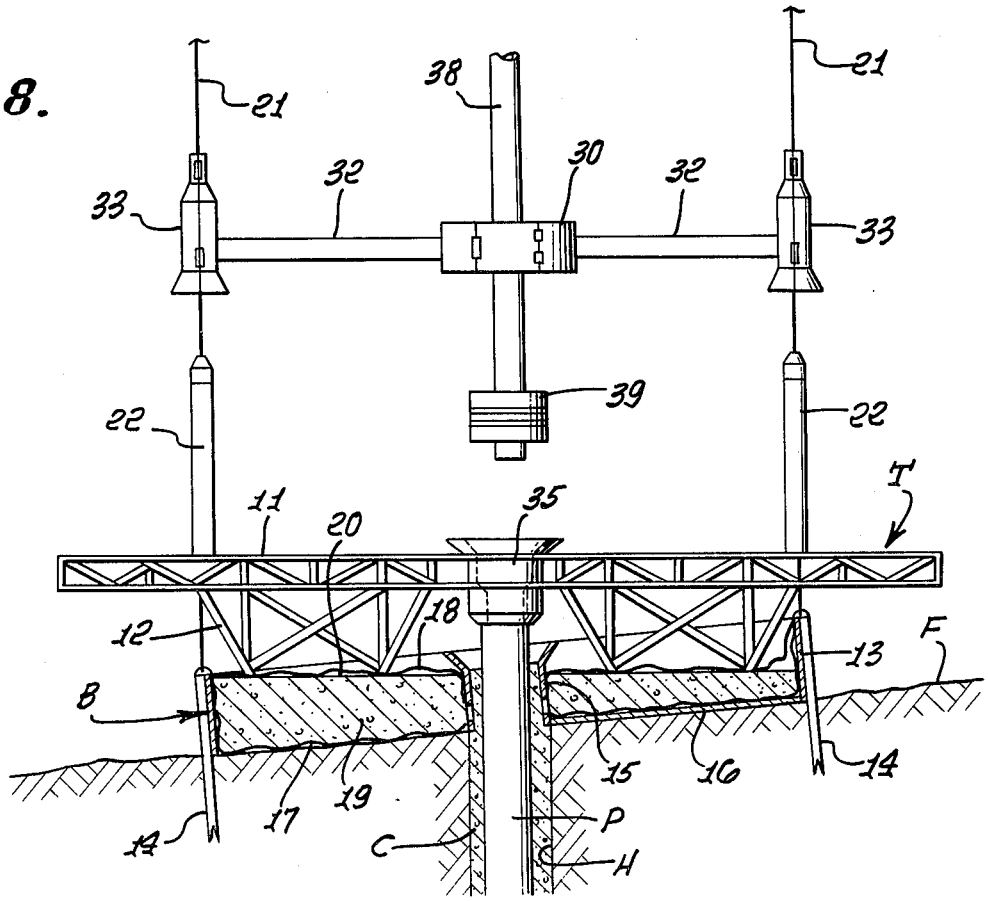

LEVEL SUBSEA TEMPLATE INSTALLATION

In the drilling and production of wells, such as oil and gas wells, beneath the water, at offshore locations, it has become the practice in deep water locations to install on the floor of the body of water structures generally referred to as templates providing a support or base for the landing or connection of various drilling and production equipment as well as for the connection thereto of anchors for towers and gravity anchors or mooring devices. In general all of the subsea structures of the type referred to as templates are anchored on the floor of the ocen or sea as by means of cementing in place piles which extend downwardly into the earth below the ocean floor.

Inasmuch as the ocean floor may not be level at the point of installation of such templates, the template must either be allowed to repose at the angle of the ocean floor, or, for example, be supported on piles set in the earth below the ocean floor by some means which can support the template structure on the piles in an elevated and level position relative to the ocean or sea floor.

It is desirable that the templates be disposed in a level condition to enable or facilitate the landing of various equipment on the template and the connection of such equipment to the template, as well as the conduct of subsequent operations such as drilling operations, the installation of production equipment or manifolding equipment for subsea pipelines, the anchoring of marine risers or moorings for floating vessels or platforms which are utilized to conduct drilling and production or workover operations.

The present invention provides for the installation of a subsea template on the ocean floor in a level condition. The reference herein to "template" is intended to mean, generically, templates useful in all of the various subsea operations wherein a template is lowered to the ocean floor. Such a template may also be a multi-purpose template, structured to enable the performance of more than one of the various subsea operations, such as the drilling and production of wells at the ocean or sea floor.

In accordance with the invention of a subsea template is installed in a level condition at the ocean floor by landing it upon a previously prepared level base. More particularly, the base is prepared by lowering to the ocean floor a large form or container into which a fluent, settable material, such as a cement slurry, can be pumped or displaced to fill the receptacle, the fluent material inherently flowing to a substantially level condition along its upper surface and setting up so as to provide a solid, level base upon which the template can be landed, and through which the template can be secured to the floor of the ocean or sea.

The form or receptacle, according to the invention, can be lowered to the ocean or sea floor on a length of pipe through which the fluent, settable material can be supplied to the form. The form or container can provide anchor points for guidelines extending to a vessel on the top of the water, and the templates subsequently lowered along the guidelines into position on the hardened level base. Alternatively, in accordance with the invention, the form and the template can be lowered together on a length of drill pipe, without guidelines, and the template somewhat elevated above the form or receptacle as the latter is being supplied through the pipe with the fluent, settable material, and then lowered onto the level base, following hardening of the settable material. After the template has been landed upon the base, a bore hole can be drilled through the template, or a plurality of bore holes can be drilled through the template for the installation of anchor piling and/or for the installation of a length of surface casing through which subsequent drilling operations can be performed.

The form or receptacle as herein disclosed is of circular configuration, but may be of various selected shapes adapted to provide a broad base for the support of the template. For example the cement form may be of circular configuration having a diameter on the order of 45 to 50 feet. In order to allow the form or receptacle to assume the necessary angle, conforming to the inclination of the sea or ocean floor, the running tool by which the form is supported, as it is being lowered through the water, includes a joint of the type allowing angular movement of the form relative to the running-in string of pipe through which the fluent, settable material is displaced. Moreover, preferably, the form contains a membrane or envelope in which the settable material is encapsulated as it is displaced into the form, to separate the settable material from the water, although such a membrane is not absolutely necessary in the use of certain cementitious materials which are settable beneath the water. However, such a membrane at the bottom of the form, supported at circumferentially spaced locations on ribs or spokes forms a barrier between the settable material and the ocean floor preventing channeling of the settable material from the form or into crevices in the sea or ocean floor. The settable material is not particularly intended to provide a bond with the ocean floor but only to rest upon the ocean floor to provide the level upper surface upon which the template can be based in a level condition. The anchoring of the template and the level base to the ocean floor is accomplished by the setting of the pile or conduit in a bore hole drilled through the template.

This invention possesses many other advantages and has other purposes which may be made more clearly apparent from a consideration of several forms and methods embodying the invention. These forms and methods are shown and described in the present specification and in the drawings accompanying and constituting a part thereof. They will now be described in detail, for the purpose of illustrating the general principles of the invention; but it is to be understood that such detailed description is not to be taken in a limiting sense.

Referring to the drawings:

FIG. 7 is a further view corresponding to FIG. 3, but showing the template landed on the level base, with the running tool disconnected from the template;

FIG. 8 is still another view corresponding to FIG. 3, but showing the template installed on the level base and the pile running and cementing tool removed from the pile;

Figure 1:
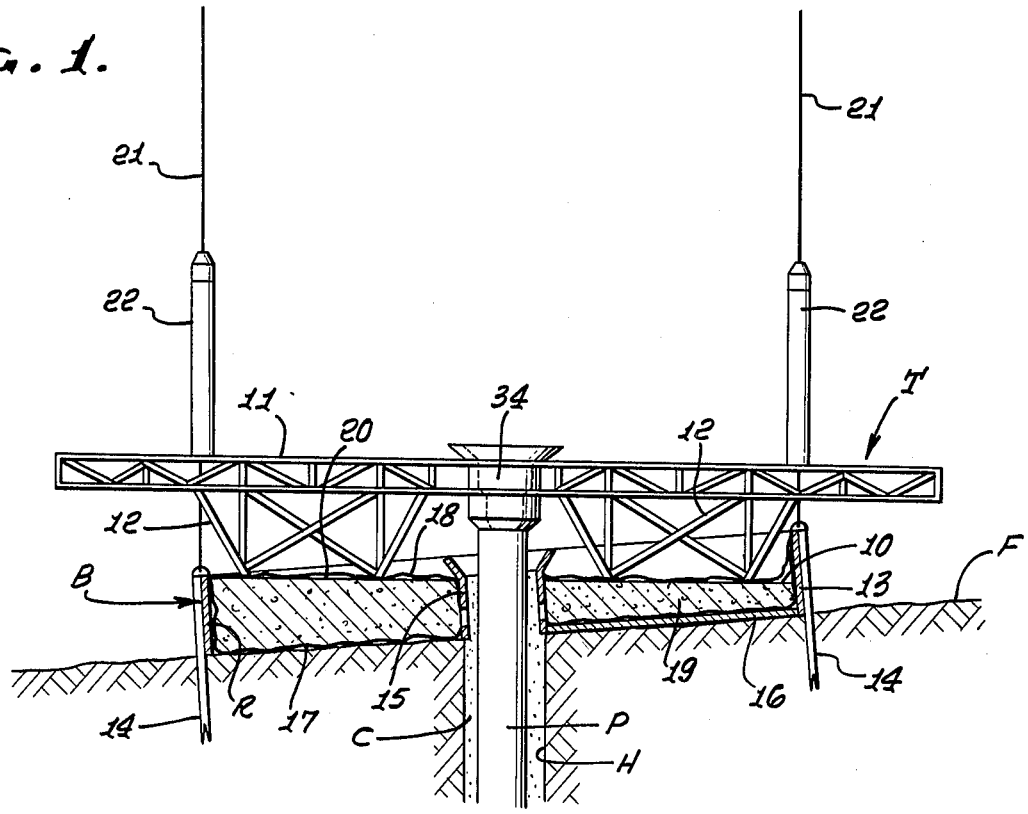
FIG. 1 is a view partly in section and partly in elevation showing a level base and template anchored to the floor of a body of water and providing guidelines for subsequent operations.
Figure 4:
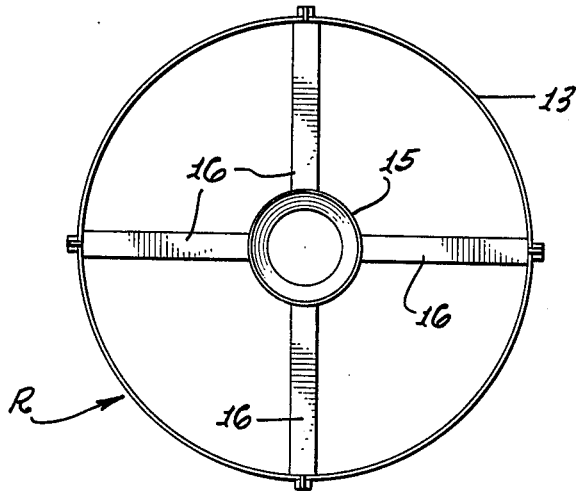
FIG. 4 is a reduced top plan illustrating the form for the base of FIG. 3.

As seen in the drawings, referring first to FIG. 1, a base B is shown landed upon the inclined surface of the floor F of a body of water and providing a level upper surface 10 on which a template T has been landed and supported in a substantially horizontal condition. A length of pile or casing P extends downwardly through the center of the base B into a bore hole H which has been drilled into earth formation through the center of the base and through the center of the template T. Cement C is in the annular space between the bore hole and the pipe P and extends upwardly into the center of the base to firmly anchor the base in place. The pipe P also extends upwardly into the center of the template T. The template T is of suitable configuration and structure and is fabricated to provide a large upper support section 11 on which various drilling and/or production equipment can be mounted, as is well-known in the case of underwater completion and production of oil and gas wells. The upper support section 11 of the template T has a number of downwardly extended base support sections 12 fabricated to provide a rigid structure beneath the support section 11 of the template and to engage the level upper surface 10 provided by the base B. Any desired or necessary number of the piles or pipes P can be installed in bore holes in the formation below the floor of the water, but only one such anchor pile is illustrated herein for the sake of simplicity. Extending downwardly along the sides of a generally circular frame structure 13 of the base B is a suitable plurality of spears or spikes 14 initially engaged in the floor F to temporarily secure the base receptacle R in place on the floor. The receptacle R may be of any desired form, but is illustrated herein as being of circular form having the outer peripheral wall 13 and a central cylindrical section 15 interconnected, as best seen in FIG. 4, by a number of radiating ribs or spokes 16 extending radially between the peripheral wall 13 and the tubular center 15. Lower and upper membranes or bladder means 17 and 18 also extend between the outer peripheral wall 13 and the tubular center 15, and contained within the space between the membranes 17 and 18 is a body of initially fluent but hard settable material such as a cement slurry 19 which has been displaced from the tubular center 15, between the membranes 17 and 18, more or less filling the space between the center of the form and the outer periphery thereof, and having inherently assumed a condition with the upper surface 20 thereof substantially level, to provide a level supporting surface for the underpinnings 12 of the template T. Extending upwardly from the template T are guidelines 21 connected with guide posts 22, which facilitate the performance of subsequent subsea operations, such as the subsequent drilling of the well through the pipe P or the subsequent connection of the various production or manifolding equipment to the template T.

Figure 2:
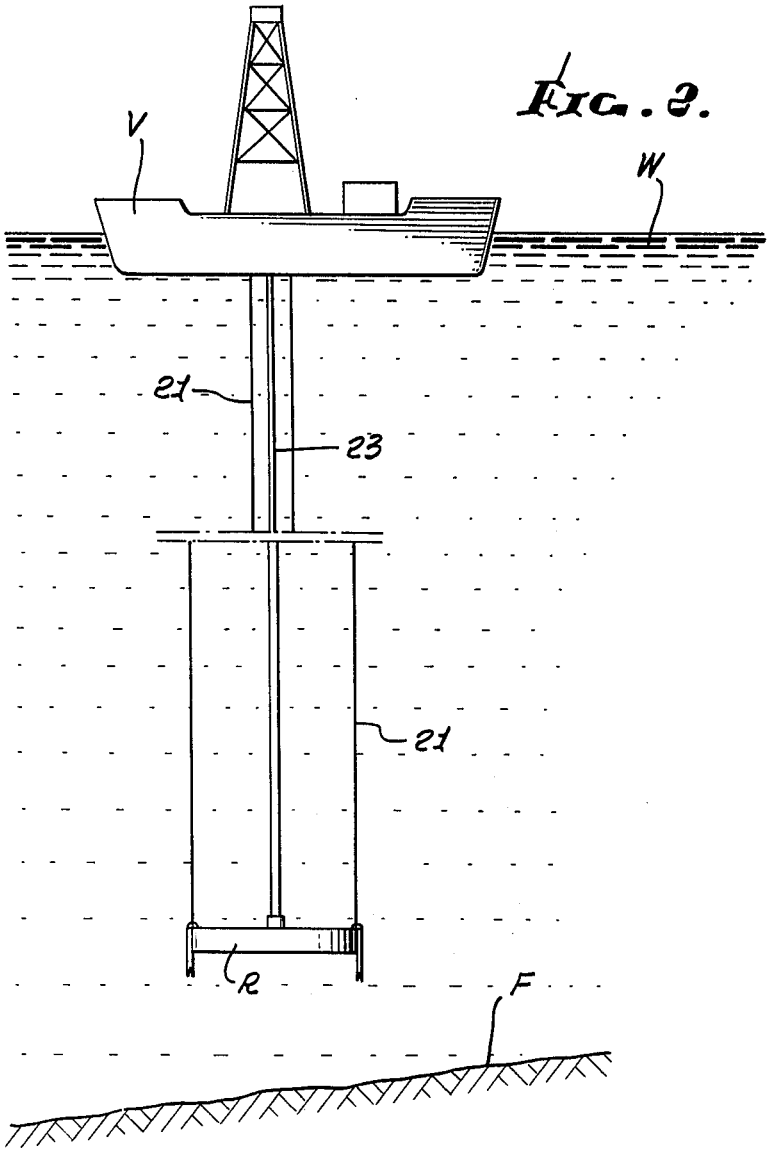
FIG. 2 is a view diagrammatically illustrating the lowering from a vessel afloat on the body, the base of FIG. 1 supported on a length of running pipe.

Referring to FIG. 2, a vessel V is shown afloat on the top of the body of water W. The receptacle or form R is adapted to be lowered from the vessel V on a length of running drill pipe 23, with the guidelines 21 connected to the receptacle R as the base is being lowered through the water towards the floor F.

Figure 3:
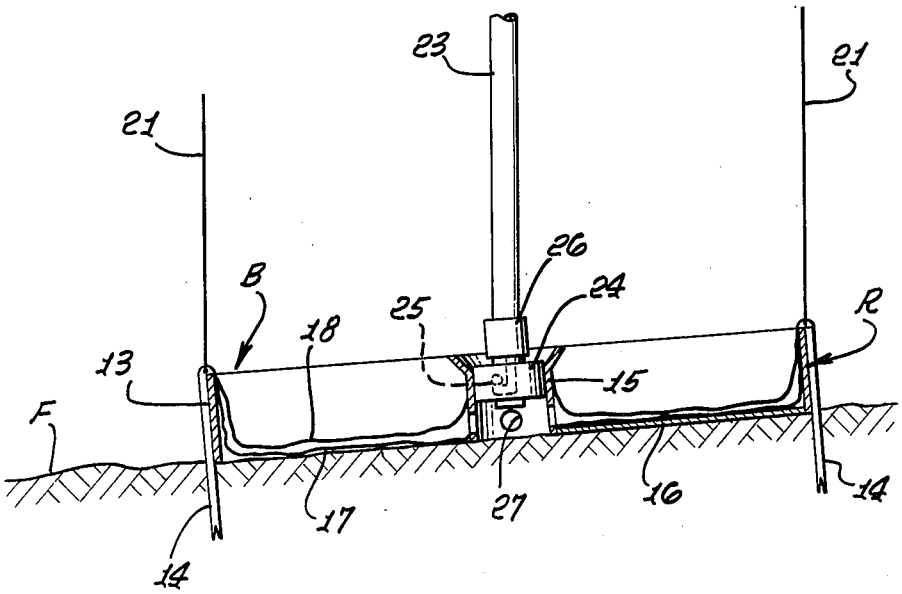
FIG. 3 is an enlarged fragmentary view illustrating the base of FIG. 2 landed on the floor of the body of water.
Figure 5:
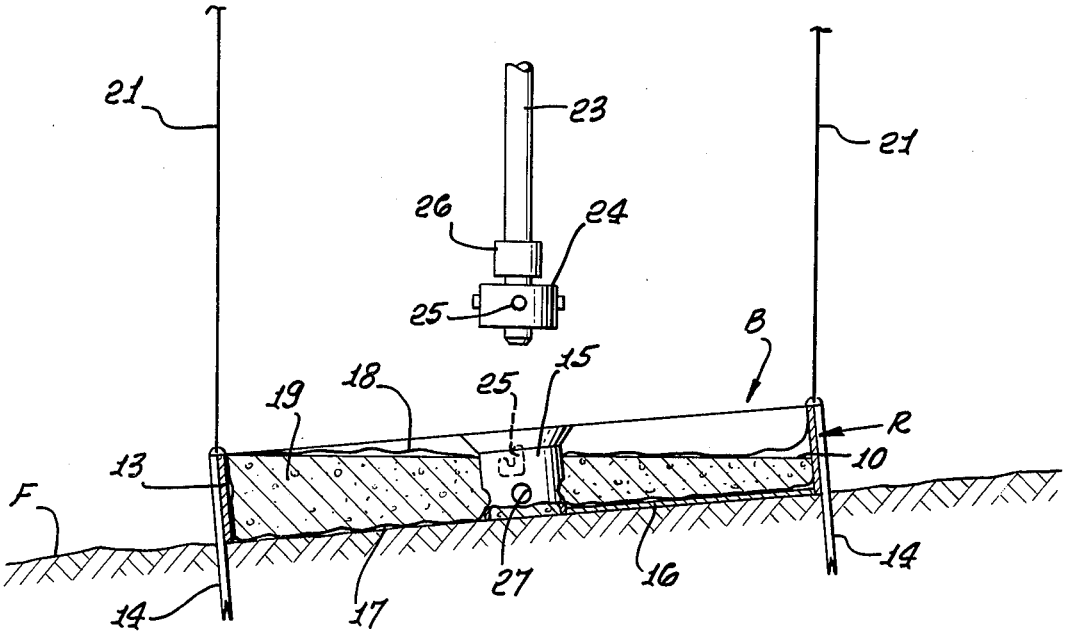
FIG. 5 is a view corresponding to FIG. 3, but illustrating the settable material in the form and the running tool released from the form.

As seen in FIG. 3, the receptacle R is connected to the running pipe string 23 by means of a releasable running tool 24 having a J-lock connection 25 with the tubular center section 15 of the receptacle. A pivotal joint 26 is provided between the tool 24 and the pipe 23, whereby upon landing of the receptacle R on the floor F, the receptacle can assume an angle with respect to the pipe string and rest upon the floor. It will be noted that the upper membrane or bladder member 18 is collapsed and that radial openings 27 in the tubular center 15 of the receptacle communicate with the space between the lower and upper membranes 17 and 18. The tool 24, as is well known in the drilling and completion of wells is adapted to conduct fluid supplied through the running pipe string 23 from the lower end of the tool into the tubular center section 15 of the receptacle, so that, as seen in FIG. 5, the fluent material can flow outwardly through the radial ports 27 into the space between the bladders 17 and 18, while the bladders separate the fluent material from the floor and from the water, to prevent channeling of the fluent material or exposure thereof to the washing effects of the water before setting of the fluent material. Following displacement of the fluent material into the space between the membranes 17 and 18, the tool 24 is released from the tubular center section 15 of the receptacle for retrieval to the vessel V. Thereupon, the fluent material between the membranes is afforded adequate time in which to set up to provide a firm level base for the subsequent application of the template T as will be later described.

Figure 6:
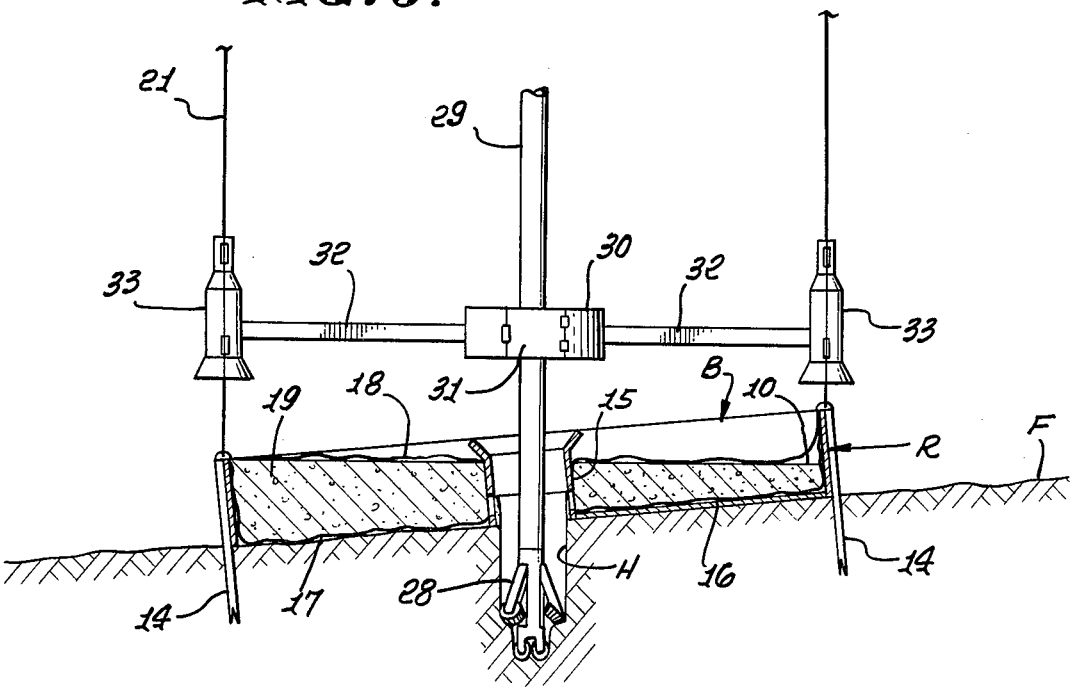
FIG. 6 is a further view corresponding to FIG. 3, but illustrating the drilling of a bore hole through the center of the form.

Referring to FIG. 6, following the displacement of the settable or cementitious material into the form or receptacle R, as just described, and after the cement is set, the bore hole H is drilled. For this purpose, a suitable bit 28, connected to the lower end of the drill pipe string 29, adapted to be rotated by the drilling rig on the vessel V, is lowered from the vessel and guided on the guidelines 21. A central guide means 30 having a side door 31, is adapted to be disposed about the drill pipe string 29 to guide the same by means of lateral arms 32 which project from the guide 30 and have at their free ends hinged guide tubes 33, adapted to be opened and closed about the guidelines, whereby the entire guide structure is constrained by the guidelines as the drilling progresses.

Following the drilling of the bore hole H, the template T, as seen in FIG. 7, is connected to a running tool 34 engaged in a central tubular member 35 within the template, the running tool 34 and the tubular member 35 having cooperatively engageable releasable means such as J-lock 36, whereby the template T can be lowered on a running pipe string 37 from the vessel V. The guide structure comprising the center guide 30 engaged about the drill pipe string 37 having the arms 32 and guides 33 engaged with the guidelines 21 constrain the template against undesired movement and cause the template to be properly positioned upon the level base. Thereupon, the running tool 34 is released from the cylindrical member 35 of the template T and the running apparatus, as seen in FIG. 7, is retrieved to the vessel.

Next, the template T is fixed in the condition shown in FIG. 1 by the apparatus and procedure illustrated in FIG. 8. The length of pile or pipe P is lowered from the vessel V at the top of the water on a length of drill pipe 38, having at its lower end a casing or pile running tool 39 of a suitable and well-known type releasably connected to the pipe P. The pipe P is landed by suitable hanger means in the tubular member 35 of the template T, and thereafter cement C is displaced in a fluid state downwardly through the drill pipe through the lower end of the pipe P and upwardly through the annular space between the pipe P and the bore hole H, substantially filling the same and flowing upwardly into the center of the base B. Movement of the pipe P or alignment thereof with the bore hole H is maintained during lowering of the pipe on the drill pipe string 38 by the previously described guide 30 having the arms 32 and guide tubes 33 which are slidable along the guidelines 21 as the pipe P is being lowered. Following the displacement of the cement C into the bore hole H, the running tool 39 is released from the pipe P for retrieval to the vessel.

It will be understood that the template T may have a plurality of the tubular members 35 through which a plurality of bore holes H may be drilled and thereby enabling the setting of a number of piles P into the earth formation to solidly anchor the template in place. In addition, it will be understood that if desired the cement C may be caused to overfill the annulus between the pipe P and the bore hole H and flow outwardly throug the upper end of the center member 15 of the base and around the underpinnings 12 of the template T to further secure the template in position upon the level base.

In any event, after the template T is firmly in place and in a level disposition, the usual subsurface equipment (not shown) on the template T can be employed either for drilling or producing wells or providing anchorage for various devices. As previously indicated, the template T may be provided with the subsea equipment when it is run, such as subsea manifold equipment, drilling equipment, production equipment, anchor points for articulated towers, subsea anchors for riser pipes, or other subsea devices. The significant point here is that the template is enabled to be installed in a horizontal or level condition by the provision of a base having a level upper surface 20 adapted to provide a pad upon which the template can be set and anchored.

While the base and template, as described above, have been separately lowered from the vessel V by the respective drill pipe or running pipe strings, and the base provides guidelines leading to the vessel for the purpose of guiding subsequent equipment including the template into place upon the base, the invention also contemplates a guidline-less installation of the base and template as more particularly illustrated in FIGS. 9 through 14.

Figure 9:
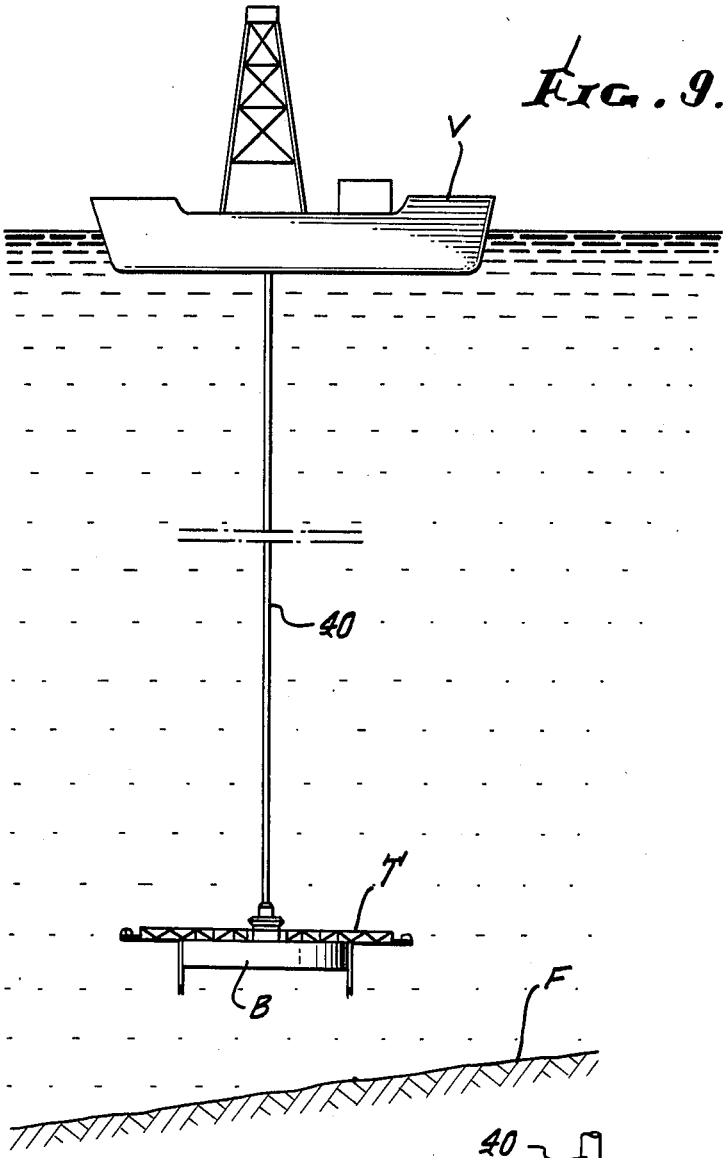
FIG. 9 is another view diagrammatically illustrating the running from a vessel afloat atop the body of water the base and the template both supported on a running pipe string for a guidelineless installation.
Figure 10:
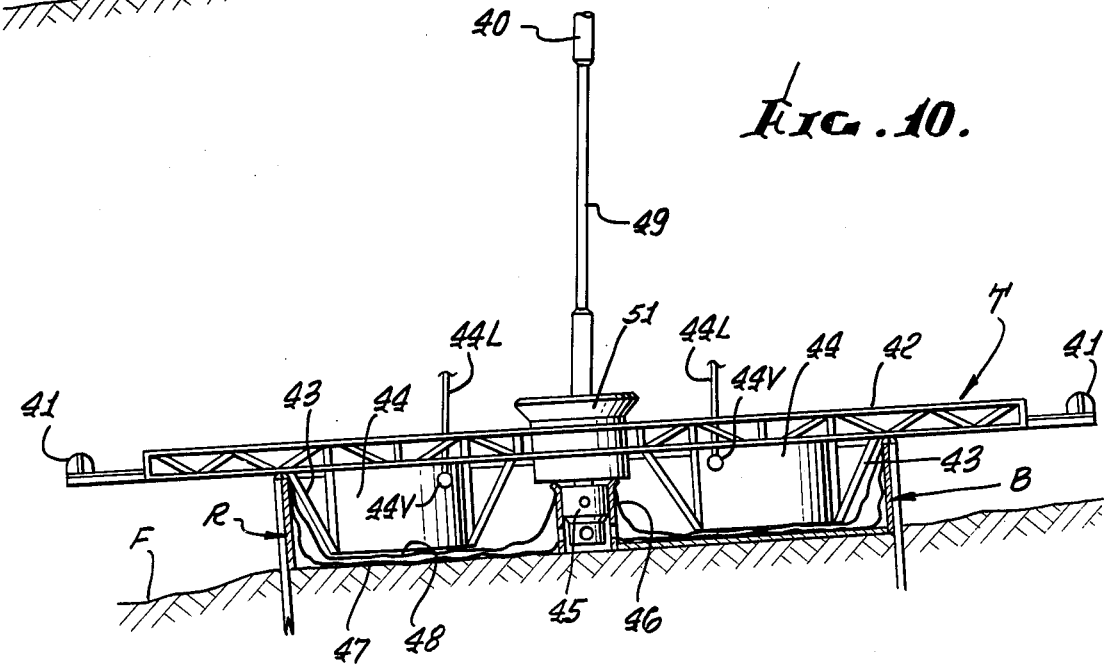
FIG. 10 is a fragmentary view illustrating the base and template structure of FIG. 9 landed upon the floor of the body of water, but prior to the application of the settable material to the base.
Figure 11:
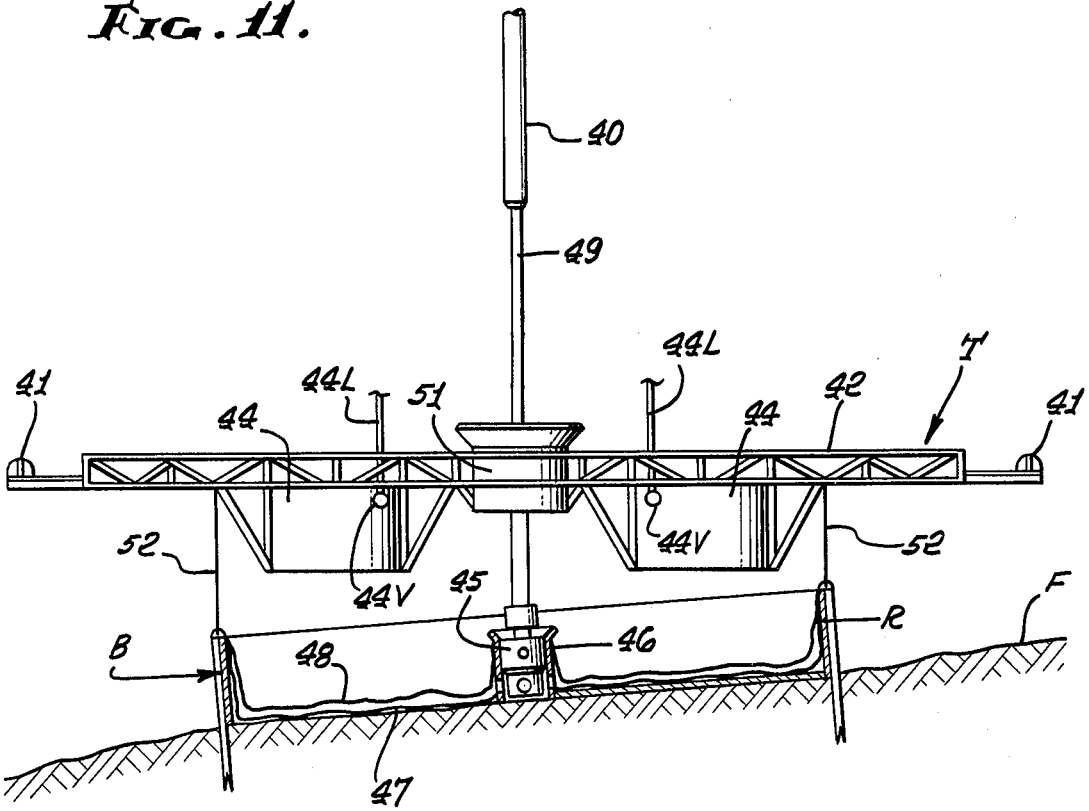
FIG. 11 is a view corresponding to FIG. 10, showing the template elevated above the base, but still prior to application of the settable material to the base.

Referring to FIG. 9, the template T will be seen to be resting upon the base B, as the two units are lowered from the vessel V afloat on top of the body of water towards the floor F at the bottom of the body of water, the floor F being disposed at an angle to the horizontal, so that when the base B lands upon the floor F the base B as well as the template T repose at the same angle to the horizontal. However, it is desired that the template be disposed in a level condition as previously described. Furthermore it will be noted that in this arrangement, the template T does not have the guidelines extending upwardly to the vessel for use in guiding the subsequent movement of equipment or other devices downwardly through the water, but the template is provided with the usual sonar reflectors 41 which facilitate the guidance of the equipment during subsequent operations.

Otherwise, the template T is essentially the same general construction as that previously described having a fabricated platform or template structure 42 extending above the downwardly projection underpinnings 43. In this arrangement the underpinnings 43 are structured to receive a suitable number of tanks 44 providing means, to be later described, whereby the template T, following landing of the base and template on the floor F, can be somewhat elevated.

As in the previously described embodiment the running pipe string 40 has a running tool 45 at its lower end connected to the central tubular section 46 of the form or receptacle R. As shown, a bumper sub 49 is in the running string to facilitate landing the structure on the bottom of the water and allowing the vessel to move vertically due to wave action. The receptacle R has a lower membrane 47 and an upper membrane 48 therein providing bladder means into which fluent, settable material such as a cement slurry can be displaced, following elevation of the template above the receptacle R.

In the illustrated embodiment, the means for elevating the template T, as previously referred to, includes the tanks 44, which during lowering of the template and the base can be filled or partially filled with water, so that the template will sink through the water, although some portion of the template weight may be supported by partial buoyancy of the tanks 44. After the template and base have been landed in the position of FIG. 10 on the floor F, suitable valve means 44V controlled by control lines 44L are provided to enable the water from the tanks to be displaced by air injected through the lines 44, until the bouyancy of the tanks causes the template T to rise above the base B. Elevation of the template T above the base is limited by anchor lines 52 interconnected between the base B and the template T. Template T can move upward around the running string.

Figure 12:
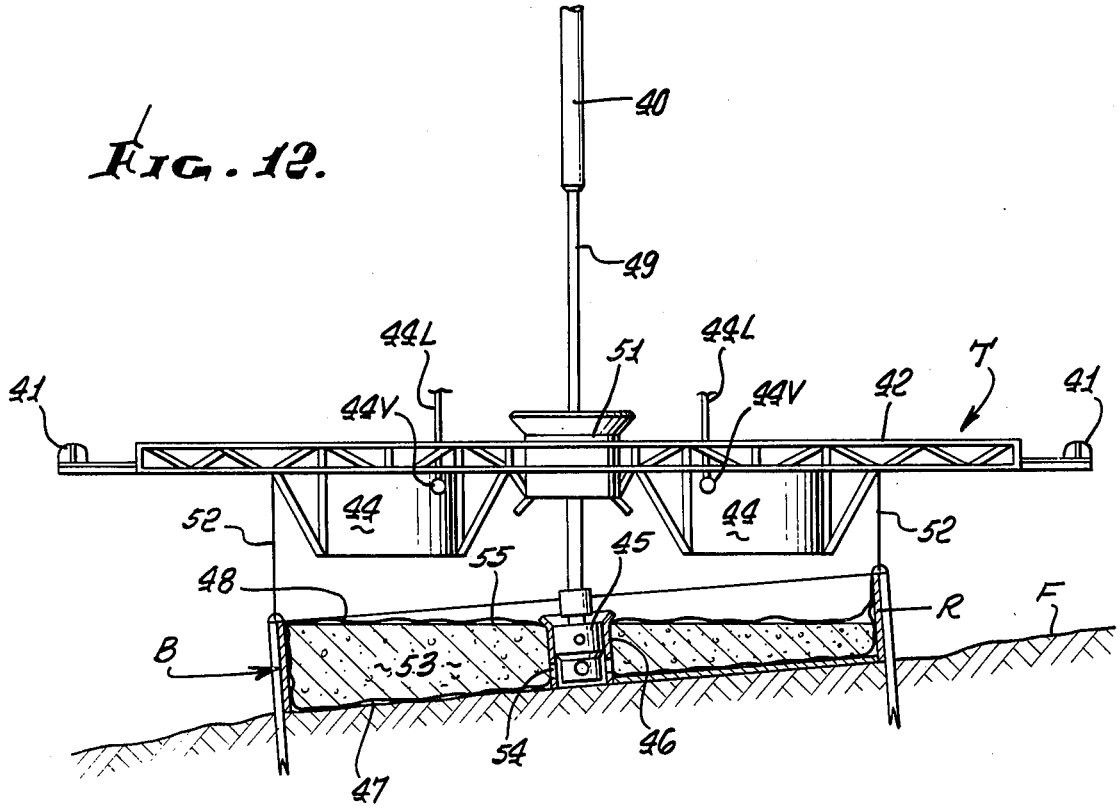
FIG. 12 is a view corresponding to FIG. 11, but showing the settable material supplied, but prior to lowering of the template to the level base.

Thereupon, as seen in FIG. 12 the fluent settable material or cementitious material 53 is displaced through the openings 54 in the central tubular section 46 of the receptacle R, between the lower and upper bladders or diaphragms 47 and 48, flowing into the space and assuming a level condition at the upper surface 55, whereby upon setting of the material 53, a solid level pad is provided for the template T.

Figure 13:
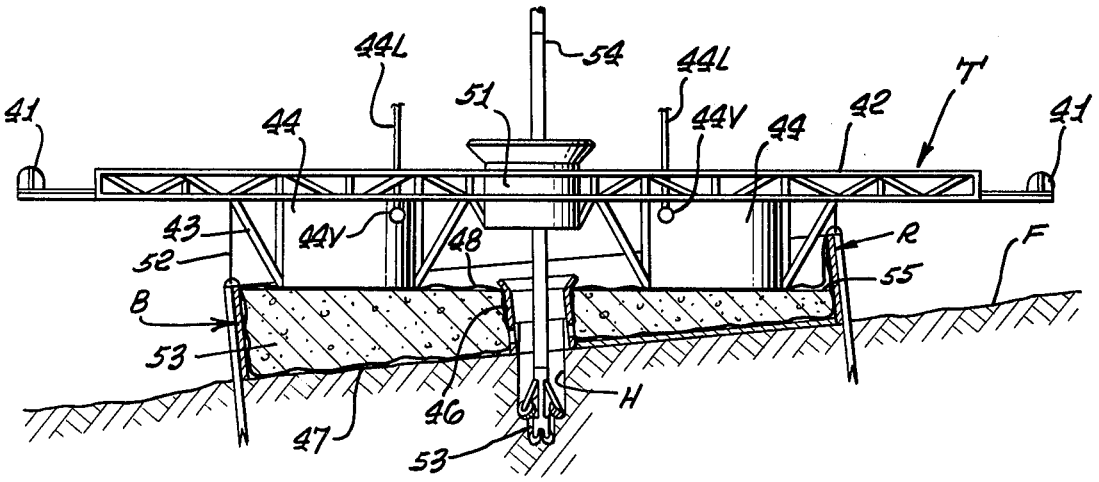
FIG. 13 is a view corresponding to FIG. 12, but showing the template lowered to the level base and the drilling of a bore hole through the template and the base.

Following the setting up of the settable material, the relief of air supplied through the lines 44L through the valves 44V is operative to allow the buoyance tanks 44 to again flood, so that the template T will gradually sink to its level position, as seen in FIG. 13, upon the level base B. Thereupon the running pipe string 40 is manipulated to release the running tool 45 from the central section 46 of the receptacle, and the running and cementing tool is retrieved to the vessel V. Then, a drill bit 53 adapted to be rotated by a drill pipe string 54 is lowered from the drilling vessel through the template tubular member 51 and into the central tubular member 46 of the base B, to enable the drilling of the bore hole H into the earth formation below the floor F.

Figure 14:
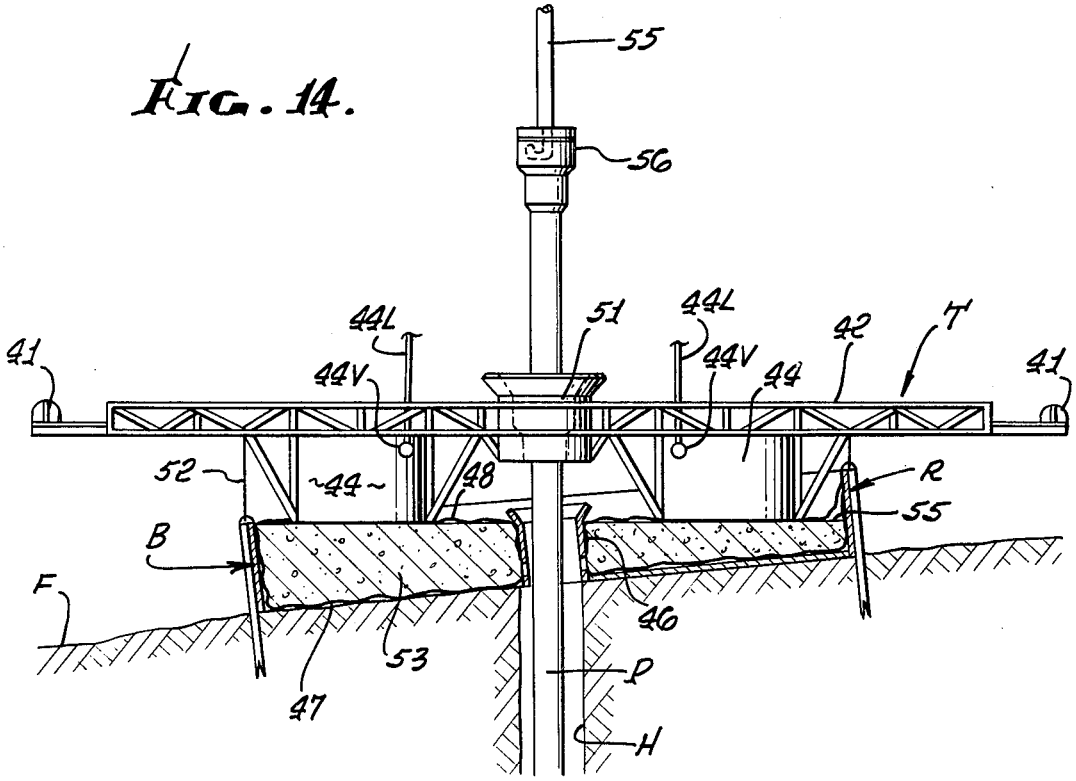
FIG. 14 is view corresponding to FIG. 13, illustrating the running of a pile into the bore hole through the template and the base.

After the bore hole H has been drilled, as seen in FIG. 14, the casing, pile or pipe P is lowered on a drill pipe string 55 connected to the casing or pipe housing 56 which lands in the usual seat in the tubular member 51 of the template T, to suspend the pipe P within the bore hole.

Thereafter, without requiring further illustration, the annular space between the bore hole H and the pipe P, as seen in FIG. 1 can be filled with cement, by displacing the cement down the drill pipe 55, through the hanger 56 and pipe P, the cement flowing upwardly through the annular space, as previously described. Thereupon, the running pipe 55, as is well known, is released from the housing 56 for recovery to the vessel. The template T is thus securely fixed to the level base with the template T disposed in a substantially level condition enabling the installation thereon of the usual subsea equipment. Here again it will be understood that the template may contain the subsea equipment as it is being lowered, or the template may be of a multi-purpose construction adapted to receive and support the various types of subsea equipment for which such templates are used, as previously described.

From the foregoing it will now be apparent that the present invention provides a novel and advantageous method for landing and supporting underwater or subsea templates on a level base, as well as novel base structure for accomplishing such results.

I claim:

1. The method of installing an underwater template in a level condition on the floor of a body of water comprising: lowering from a rig at the top of the water to the floor on a running pipe, a receptacle for a quantity of fluent, settable material; supplying fluent material to said receptacle through said pipe; allowing said fluent material to settle to provide a level upper surface on said fluent material; removing said running pipe; allowing said fluent material to set and form a firm base with a level upper surface; and then landing an underwater template on the level upper surface of the base.

2. The method of claim 1; wherein said receptacle has bladder means separating said fluent material from the water.

3. The method of claim 1; wherein said receptacle has a lower membrane engaged with the floor and separating said fluent material from the floor.

4. The method of claim 1; wherein said receptacle has a lower membrane engaged with the floor and separating said fluent material from the floor; said receptacle having an upper membrane separating said fluent material from the water.

5. The method of installing an underwater template in a level condition on the floor of a body of water comprising: lowering from a rig at the top of the water to the floor, a receptacle for a quantity of fluent, settable material; supplying fluent material to said receptacle to provide a level upper surface on said fluent material; allowing said fluent material to set and form a firm base with a level upper surface; and then landing an underwater template on the level upper surface of the base; and including drilling a bore hole through said template and receptacle into the earth formation below the floor; lowering a pipe into said bore hole and supporting said pipe on said template; and then cementing said pipe in said bore hole to anchor said template on said base.

6. The method of claim 1; including extending guide lines from said receptacle to the rig, and lowering said template on said guide lines to land said template on said base.

7. The method of claim 1; including lowering said template together with said receptacle and elevating said template from said receptacle before supplying said fluent material and lowering said template to land said template on said base.

8. The method of claim 1; including lowering said template together with said receptacle, supplying air to a water-containing buoyancy tank on said template to raise said template above said receptacle before supplying said fluent material, and flooding said tank with water to lower said template and land said template on said base.

9. The method of installing an underwater template in a level condition on the floor of a body of water comprising: lowering from a rig at the top of the water to the floor, a receptacle for a quantity of fluent, settable material; supplying fluent material to said receptacle to provide a level upper surface on said fluent material; allowing said fluent material to set and form a firm base with a level upper surface; and then landing an underwater template on the level upper surface of the base; and including lowering said receptacle on a pipe string releasably connected with said receptacle, supplying said fluent material to said receptacle through said pipe string, and releasing said pipe string from said receptacle, and including drilling a bore hole through said template and receptacle into the earth formation below the flow; lowering a pipe into said bore hole and supporting said pipe on said template; and then cementing said pipe in said bore hole to anchor said template on said base.

10. The method of claim 9; including extending guide lines from said receptacle to the rig, and lowering said template on said guide lines to land said template on said base.

11. The method of claim 10; including lowering said template together with said receptacle and elevating said template from said receptacle before supplying fluent material, and lowering said template to land said template on said base.

12. The method of installing an underwater template in a level condition on the floor of a body of water comprising: releasably connecting a form having an open top to a running pipe string; lowering the form on the pipe string to the floor, with guide lines connected to the form and extending to the rig; supplying a fluent, settable material to the form through the pipe string; allowing the fluent material to set to form a base on the floor having a level top; removing the running pipe string; drilling a bore hole into the earth below the floor through the base; lowering from the rig and guiding on the guide lines, a template structure having a pipe support aligned with the bore hole; releasably connecting a pipe to another running pipe string; lowering said pipe on said another pipe string while guiding the pipe by said guide lines into the bore hole through said pipe support and said base; displacing cement slurry through said another pipe string and said pipe into the bore hole to cement said pipe in said bore hole and fix said template on said base; and retrieving said another pipe string.

13. The method of claim 12; wherein said form has bladder means for receiving said fluent material.

14. The method of installing an underwater template in a level condition on the floor of a body of water comprising; releasbaly connecting a form having an open top to a running pipe string with a template disposed above said form; lowering the form and the template on the pipe string to the floor; raising the template to a location spaced above the form; supplying a fluent, settable material to the form through the pipe string; allowing the fluent material to set to form a base on the floor having a level top; lowering the template onto the top of the base; drilling a bore hole into the earth through said template and said base; releasably connecting a pipe to another running pipe string; lowering said pipe through said template and said base into said bore hole; supporting said pipe on said template; displacing cement slurry through said another pipe string and said pipe into the bore hole to cement said pipe in said bore hole and fix said template on said base; and retrieving said another pipe string.

15. The method of claim 14; wherein said form has bladder means for receiving said fluent material.

16. The method of installing an underwater template in a level condition on the floor of a body of water comprising: lowering from a rig at the top of the water to the floor, a receptacle for a quantity of fluent, settable material; supplying fluent material to said receptacle to provide a level upper surface on said fluent material; allowing said fluent material to set and form a firm base with a level upper surface; then landing an underwater template on the level upper surface of the base; installing a pipe into the earth through said template and said base; and fixing said template and pipe together.

17. Apparatus for supporting an underwater template in a level position on the floor of a body of water comprising: means providing a form having a peripheral wall and a tubular support within said peripheral wall; means supporting said peripheral wall on said tubular support; a running pipe string for conducting a fluent, settable material to said tubular support, including a joint enabling angular movement of said form; said tubular support having means releasably connectable with said pipe string; and passage means in said tubular support for said fluent, settable material communicating with the space between said tubular support and said peripheral wall.

18. Apparatus as defined in claim 17; including means providing top and bottom membranes between said tubular support and said peripheral wall.

19. Apparatus as defined in claim 17; including anchor spears carried by said peripheral wall and projecting downwardly therefrom for engagement in the floor.

20. Apparatus as defined in claim 17; including guide means on said peripheral wall extensible upwardly therefrom for guiding a template towards said form.

* * * * *